US010843329B1

(12) United States Patent
Sterns

(10) Patent No.: US 10,843,329 B1
(45) Date of Patent: Nov. 24, 2020

(54) ALL TERRAIN CREEPER

(71) Applicant: Whiteside Mfg. Co., Delaware, OH (US)

(72) Inventor: Jason Sterns, Joplin, MO (US)

(73) Assignee: WHITESIDE MFG. CO., Delaware, OH (US)

( * ) Notice: Subject to any disclaimer, the term of this patent is extended or adjusted under 35 U.S.C. 154(b) by 0 days.

(21) Appl. No.: 16/529,971

(22) Filed: Aug. 2, 2019

Related U.S. Application Data

(60) Provisional application No. 62/713,624, filed on Aug. 2, 2018.

(51) Int. Cl.
*B25H 5/00* (2006.01)

(52) U.S. Cl.
CPC ..... *B25H 5/00* (2013.01)

(58) Field of Classification Search
CPC ..... B25H 5/00
See application file for complete search history.

(56) References Cited

U.S. PATENT DOCUMENTS 4,185,846 A * 1/1980 Black ..... B25H 5/00 280/11.115
4,395,186 A * 7/1983 Whyte ..... A01B 75/00 180/280
D356,412 S * 3/1995 Hensley, Jr. ..... D34/23
5,397,139 A * 3/1995 Simpson ..... B25H 5/00 280/32.6
6,578,859 B2 * 6/2003 Chen ..... A47C 7/006 280/32.5
7,032,907 B1 * 4/2006 Marsh ..... B25H 5/00 280/32.5
7,114,742 B1 10/2006 Sterns
9,925,659 B1 * 3/2018 Clemmer ..... B25H 5/00
2006/0186619 A1 * 8/2006 Sieb ..... B25H 5/00 280/32.6
2009/0102147 A1 * 4/2009 Moorhead ..... B62B 5/0083 280/32.6

* cited by examiner

*Primary Examiner* — Brian L Swenson

(74) *Attorney, Agent, or Firm* — Renner Kenner Greive Bobak Taylor & Weber

(57) ABSTRACT

A creeper includes a frame having opposed side rails with first and second ends. A first wheel is carried by and extends above each side rail and is spaced a first distance from the first end of the side rails. A second wheel is carried by and extends above each side rail and is spaced a second distance from the second end of the side rails. The first distance is less than the second distance, and the wheels are spaced from each other a third distance which is less than the first and second distances. A fender is carried by each side rail and each fender covers a pair of the first and second wheels.

13 Claims, 2 Drawing Sheets

ALL TERRAIN CREEPER

CROSS-REFERENCE TO RELATED APPLICATION

This application claims the benefit of U.S. Provisional Application No. 62/713,624 filed Aug. 2, 2018, the contents of which are incorporated herein by reference.

TECHNICAL FIELD

This invention relates to a creeper which is often used by a mechanic when servicing vehicles. More particularly, this invention relates to a creeper which is usable on a variety of surfaces.

BACKGROUND ART

Creepers used by mechanics or the like to assist them in servicing vehicles are well known in the art. Typically they include some type of platform which is supported by casters. The user generally lays on that platform and can maneuver it on the casters to the desired service location, for example, under the vehicle. Such creepers can adequately be maneuvered on a smooth surface, but in uneven terrain, for example, a gravel driveway, facile maneuverability is almost impossible.

Thus, the need exists for a creeper which can readily be used on any type of terrain.

SUMMARY OF THE INVENTION

It is thus an object of one aspect of the present invention to provide a creeper which is capable of traversing almost any terrain.

It is an object of another aspect of the invention to provide a creeper, as above, which is readily maneuverable by the user.

It is an object of an additional aspect of the invention to provide a creeper, as above, which has large wheels which are covered by fenders.

These and other objects of the present invention, as well as the advantages thereof over existing prior art forms, which will become apparent from the description to follow, are accomplished by the improvements hereinafter described and claimed.

In general, a creeper made in accordance with one aspect of the invention includes a frame having opposed side rails with first and second ends. A first wheel is carried by each side rail and is spaced a first distance from the first end. A second wheel is carried by each side rail and is spaced a second distance from the second end. The wheels are spaced from each other a third distance which is less than the first and second distances.

In accordance with another aspect of the present invention, a creeper includes a frame having opposed side rails. A pair of wheels is carried by each side rail and extends above the said rails. A fender is carried by each side rail which covers each pair of wheels.

A creeper made in accordance with these aspects of the present invention includes a frame having opposed side rails with first and second ends A first wheel is carried by each side rail and is spaced a first distance from the first end. A second wheel is carried by each side rail and is spaced a second distance from the second end. The wheels are spaced from each other a third distance which is less than the first and second ends. Each pair of first and second wheels is covered by a fender.

A preferred exemplary creeper according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
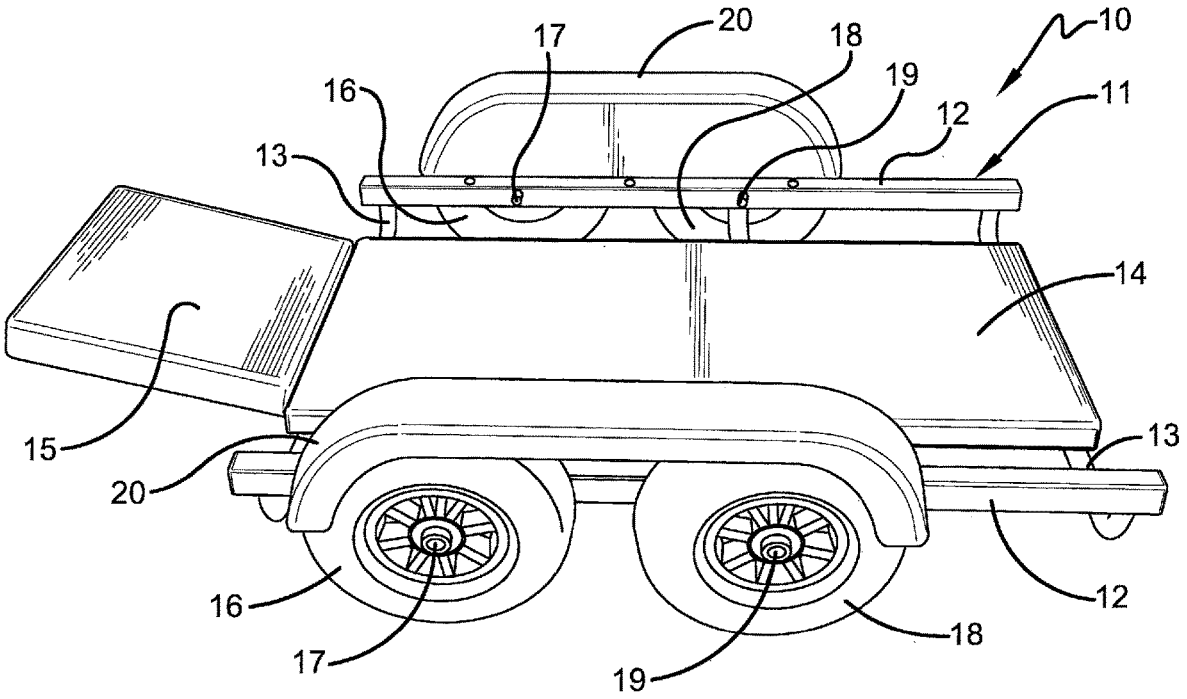
FIG. 1 is a perspective view of an all terrain creeper made in accordance with the present invention.
Figure 2:
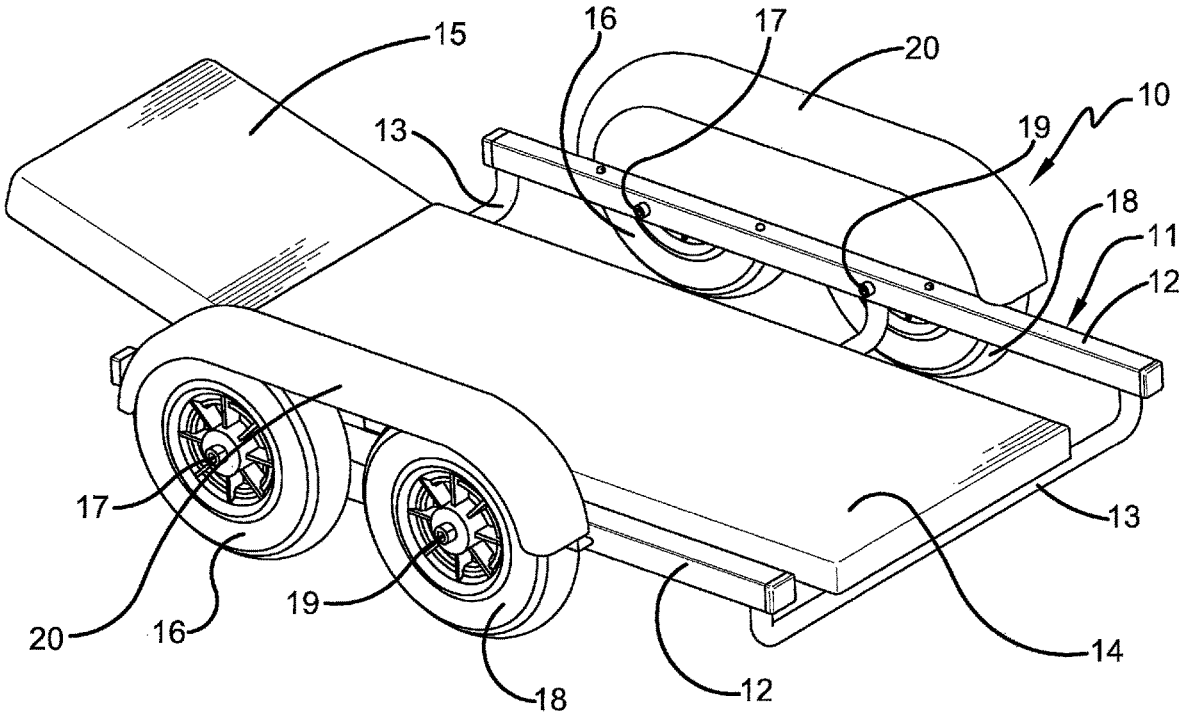
FIG. 2 is another perspective view of the creeper of FIG. 1.

A creeper which is especially adapted for use on any type of terrain is generally indicated by the numeral 10 in the drawings. Creeper 10 includes a frame, generally indicated by the numeral 11, which includes opposed side rails 12 and at least two cross-rails 13 extending between the side rails 12. Cross-rails 13 support a pad 14 which is provided for the body of the user and which can be made of a foam or the like. A headrest pad 15 is supported by a frame (not shown) which extends at an angle upwardly from a cross-rail 13.

An opposed pair of front wheels 16 are rotatably carried on axles 17 supported by side rails 12, and an opposed pair of rear wheels 18 are rotatably carried on axles 19 supported by side rails 12. Wheels 16 are spaced from the front end of creeper 10 (the end of headrest pad 15), and wheels 18 are spaced from the rear end of creeper 10 by a distance which is greater than the distance between wheels 16 and 18. Thus, wheels 16 and 18 are positioned close to each other and generally centrally of the longitudinal extent of creeper 10. However, the axles 17 for front wheels 16 are closer to the front end of side rails 12 than the distance that the axles 19 for rear wheels 18 are located from the rear end of side rails 12.

A fender 20 is carried by each side rail 12. Fenders 20 extend over the top of wheels 16 and 18 and continues down the front of wheel 16 and down the rear of wheel 18 such that more than ninety degrees of the wheels are covered. As such, fenders 20 protect wheels 16 and 18 and also prevent them from engaging, for example, the clothing of a user.

Unlike the wheels of prior art creepers which are casters that can swivel over three hundred sixty degrees, wheels 18 rotate on axles 19 to move creeper 10 in a longitudinal direction. In addition, wheels 18 are large, extending above the height of the side rails 12. For example, wheels 16 and 18 may have a diameter of eight to ten inches. As such, they can readily traverse even the roughest of terrains that might be encountered by the user. Although, wheels 16 and 18 can only move creeper 10 in a straight longitudinal direction, the orientation and location of wheels 16 and 18, as previously described, permit rotational movement of creeper 10. That is, the user can readily lean back on headrest pad 15 to pivot creeper 10 on wheels 16 thereby lifting wheels 18 off the ground. In that position, creeper 10 may be rotated so that once wheels 18 are back on the ground, it can be moved longitudinally to the desired location.

It should be evident that an all terrain creeper constructed as described herein substantially improves the art.

What is claimed is:

1. A creeper comprising a frame including opposed side rails having first and second ends, a first wheel carried by each said side rail and spaced a first distance from one longitudinal end of the creeper, a second wheel carried by each said side rail and spaced a second distance from the opposed longitudinal end of the creeper, said wheels being spaced from each other a third distance, said third distance being less than said first and second distances.

2. The creeper of claim 1 further comprising a fender carried by each said side rail, each said fender covering a said first wheel and a said second wheel.

3. The creeper of claim 2 wherein each said fender covers the top of said wheels and approximately ninety degrees of said wheels.

4. The creeper according to claim 1 wherein each said first and second wheels are rotatable on an axle carried by said frame, said axle for said first wheel being located a first distance from said first end of said side rail, and said axle for said second wheel being located a second distance from said second end of said side rail, said second distance being larger than said first distance.

5. The creeper of claim 1, said frame including cross rails extending between said side rails, and further comprising a pad carried by said cross rails.

6. A creeper comprising a frame having opposed side rails, a first wheel carried by one side rail, a second wheel carried by said one side rail, a third wheel carried by the other side rail, a forth wheel carried by said other side rail said wheels extending above said side rails, a fender carried by each said side rail, one said fender covering said first and second wheels and the other said fender covering said third and fourth wheels.

7. The creeper of claim 6 wherein each said fender covers the top of said wheels and approximately ninety degrees of said wheels.

8. A creeper comprising a frame including opposed side rails having ends, a pair of wheels carried by said frame each wheel of said pair of wheels being rotatable on an axle carried by said frame, said axle for one of the wheels of each pair of wheels being located a first distance from one end of said side rail, and said axle for the other wheel of each pair of wheels being located a second distance from the other end of said side rail, said second distance being larger than said first distance.

9. A creeper comprising a frame including opposed side rails having first and second ends, a first wheel carried by each said side rails and spaced a first distance from one longitudinal end of the creeper, a second wheel carried by each said side rail and spaced a second distance from the opposed longitudinal end of the creeper, said wheels being spaced from each other a third distance, said third distance being less than said first and second distances, and a fender carried by said frame, said first and second wheels on each side rail being covered by a said fender.

10. The creeper of claim 9 wherein said first distance is less than said second distance.

11. The creeper of claim 9 wherein each said fender covers the top of said wheels and approximately ninety degrees of said wheels.

12. The creeper of claim 9 further comprising a body pad carried by said frame.

13. The creeper of claim 12 further comprising a headrest pad carried by said frame and extending upwardly from said body pad at an angle.

* * * * *